US007316290B2

(12) United States Patent
Hutt et al.

(10) Patent No.: US 7,316,290 B2
(45) Date of Patent: Jan. 8, 2008

(54) ACOUSTIC LENS SYSTEM

(75) Inventors: Steven W Hutt, Bloomington, IN (US); John F Steere, Martinsville, IN (US); D. B Keele, Jr., Bloomington, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 379 days.

(21) Appl. No.: 10/768,283

(22) Filed: Jan. 29, 2004

(65) Prior Publication Data

US 2004/0182642 A1 Sep. 23, 2004

Related U.S. Application Data

(60) Provisional application No. 60/443,699, filed on Jan. 30, 2003.

(51) Int. Cl.
*G10K 11/08* (2006.01)
*H04R 7/06* (2006.01)
*H04R 1/28* (2006.01)

(52) U.S. Cl. ..... 181/176; 381/356; 381/357; 381/431; 381/396; 381/191; 381/391

(58) Field of Classification Search ..... 381/357, 381/431, 399, 408, 191, 396, 391, 356; 181/176, 181/192
See application file for complete search history.

(56) References Cited

U.S. PATENT DOCUMENTS 1,643,791 A 9/1927 Slepian
2,566,604 A 9/1951 Eaves
3,141,071 A 7/1964 Rich
3,164,686 A 1/1965 Tibbetts
3,570,626 A 3/1971 Mochida et al.
3,654,403 A 4/1972 Bobb
3,674,946 A 7/1972 Winey
3,919,499 A 11/1975 Winey
3,957,134 A * 5/1976 Daniel ..... 181/176
4,037,061 A 7/1977 von Recklinghausen
4,210,786 A 7/1980 Winey
4,264,789 A 4/1981 Kaizu et al.

(Continued)

FOREIGN PATENT DOCUMENTS

DE 1 799 329 11/1959

(Continued)

OTHER PUBLICATIONS

"Dynamic Amplitude Shading of Electronically Steered Line Source Arrays," an Audio Engineering Society Preprint 3272; Richard Schmidmaier, David G. Meyer, presented at the 92nd Convention Mar. 24-27, 1992.

(Continued)

*Primary Examiner*—Lincoln Donovan
*Assistant Examiner*—Jeremy Luks
(74) *Attorney, Agent, or Firm*—Pauley Petersen & Erickson

(57) ABSTRACT

A loudspeaker includes a frame, a magnet coupled to the frame and a diaphragm secured to the frame. An acoustic lens may be positioned in front of the diaphragm. An aperture extends through the acoustic lens. The acoustical directivity pattern of the loudspeaker may be modified by the acoustic lens to improve the uniformity of the off axis vs. on axis sound pressure level.

28 Claims, 16 Drawing Sheets

U.S. PATENT DOCUMENTS

| | | | | |
|---|---|---|---|---|
| 4,281,223 | A | | 7/1981 | Ugaji et al. |
| 4,316,062 | A | | 2/1982 | Beveridge |
| 4,384,173 | A | | 5/1983 | Briefer et al. |
| 4,468,530 | A | | 8/1984 | Torgeson |
| 4,471,172 | A | | 9/1984 | Winey |
| 4,471,173 | A | | 9/1984 | Winey |
| 4,480,155 | A | | 10/1984 | Winey |
| 4,484,037 | A | | 11/1984 | Nieuwendijk et al. |
| 4,536,623 | A | | 8/1985 | Larson |
| 4,544,805 | A | | 10/1985 | Sawafuji et al. |
| 4,584,439 | A | | 4/1986 | Paddock |
| 4,653,103 | A | | 3/1987 | More et al. |
| 4,703,510 | A | | 10/1987 | Larson |
| 4,723,296 | A | | 2/1988 | Nieuwendijk et al. |
| 4,750,257 | A | | 6/1988 | Larson |
| 4,803,733 | A | | 2/1989 | Carver et al. |
| 4,837,838 | A | | 6/1989 | Thigpen et al. |
| 4,924,504 | A | | 5/1990 | Burton |
| 4,939,784 | A | | 7/1990 | Bruney |
| 5,021,613 | A | | 6/1991 | Garcia |
| 5,115,883 | A | * | 5/1992 | Morikawa et al. ..... 181/152 |
| 5,148,493 | A | | 9/1992 | Bruney |
| 5,195,143 | A | | 3/1993 | Spiegel et al. |
| 5,283,836 | A | | 2/1994 | Trufitt |
| 5,297,214 | A | | 3/1994 | Bruney |
| 5,430,805 | A | | 7/1995 | Stevenson et al. |
| 5,627,903 | A | | 5/1997 | Porrazzo et al. |
| 5,682,436 | A | | 10/1997 | Sakamoto et al. |
| 5,764,595 | A | | 6/1998 | Power |
| 5,793,876 | A | * | 8/1998 | Derogis et al. ..... 381/89 |
| 5,850,461 | A | | 12/1998 | Zelinka |
| 5,901,235 | A | | 5/1999 | Thigpen |
| 5,905,805 | A | | 5/1999 | Hansen |
| 5,953,438 | A | | 9/1999 | Stevenson et al. |
| 5,961,762 | A | | 10/1999 | Zelinka et al. |
| 6,008,714 | A | | 12/1999 | Okuda et al. |
| 6,097,830 | A | | 8/2000 | Zelinka et al. |
| 6,104,825 | A | | 8/2000 | Thigpen |
| 6,154,557 | A | * | 11/2000 | Montour et al. ..... 381/431 |
| 6,185,310 | B1 | | 2/2001 | Kermani et al. |
| 6,546,106 | B2 | | 4/2003 | Azima |
| 6,845,166 | B2 | | 1/2005 | Hara et al. |
| 2001/0009586 | A1 | | 7/2001 | Suzuki |
| 2001/0048256 | A1 | | 12/2001 | Miyazaki et al. |
| 2002/0191808 | A1 | | 12/2002 | Croft, III et al. |

FOREIGN PATENT DOCUMENTS

| | | | | |
|---|---|---|---|---|
| DE | 30 33 631 | A1 | | 4/1982 |
| DE | 30 38 905 | A1 | | 5/1982 |
| EP | 0 996 311 | A1 | | 4/2000 |
| EP | 1 158 835 | A2 | | 11/2001 |
| EP | 1 194 001 | A1 | | 4/2002 |
| FR | 2 765 767 | | | 1/1999 |
| GB | 2 034 153 | A | | 5/1980 |
| JP | 54076130 | | | 6/1979 |
| JP | 54098612 | | | 8/1979 |
| JP | 57184398 | | | 11/1982 |
| JP | 01226298 | A | * | 9/1989 |
| JP | 01228300 | | | 9/1989 |
| JP | 08331684 | | | 12/1996 |
| WO | WO 95/24815 | | | 9/1995 |

OTHER PUBLICATIONS

"Line Arrays: Theory and Applications," Audio Engineering Society, Convention Paper 5304; Mark S. Ureda, presented at the 110th Convention May 12-15, 2001.

"Analysis of Loudspeaker Line Arrays" by Mark S. Ureda, J. Audio Eng. Soc., vol. 52, No. 5, May 2004.

"Dynamic Amplitude Shading of Electronically Steered Line Source Arrays," an Audio Engineering Society Preprint 3272; Richard Schmidmaier, Munchen, Germany; David G. Meyer, School of Electrical Engineering, Purdue University, West Lafayette, Indiana, no date.

"Line Arrays: Theory and Applications," Audio Engineering Society, Convention Paper 5304; Mark S. Ureda, JBL Professional, Northridge, CA; presented at the 110th Convention May 12-15, 2001, Amsterdam, The Netherlands.

EDM Charmilles; A Practical Guide to Electro-Discharge Machining; Ateliers des Charmilles S.A. (p. 12-13), no date.

Furihata et al., "Acoustic characteristics of an electrodynamic planar digital loudspeaker." J Acoustical Society of America 114(1):174-184, Jul. 2003.

"Analysis of Loudspeaker Line Arrays" by Mark S. Ureda, J. Audio Eng. Soc., vol. 52 No. 5.. May 2004.

* cited by examiner

ACOUSTIC LENS SYSTEM

CROSS-REFERENCE TO RELATED APPLICATIONS

This application claims the benefit of U.S. Provisional Application No. 60/443,699, filed on Jan. 30, 2003. The disclosure of U.S. Provisional Application No. 60/443,699 is incorporated by reference in its entirety.

BACKGROUND OF THE INVENTION

1. Field of the Invention

The invention relates to electro-dynamic planar loudspeakers, and more particularly, to ways of controlling and/or enhancing the acoustical directivity pattern of an electro-dynamic planar loudspeaker.

2. Related Art

In the field of electro-dynamic planar loudspeakers, a diaphragm in the form of a thin film is attached in tension to a frame. An electrical circuit is applied to the surface of the diaphragm in the form of electrically conductive traces. A magnetic field is generated by a magnetic source that is mounted adjacent to the diaphragm. Typically, the magnetic source is formed from permanent magnets mounted within the frame. The diaphragm is caused to vibrate in response to an interaction between current flowing between the electrical circuit and the magnetic field generated by the magnetic source. The vibration of the diaphragm produces the sound that is generated by the electro-dynamic planar loudspeaker.

Many types of design and manufacturing challenges present themselves with regard to the manufacture of the electro-dynamic planar loudspeakers. First, the diaphragm, which is formed by a thin film, needs to be applied to the frame in tension and permanently attached thereto. Correct tension is required to optimize the resonance frequency of the diaphragm. An optimized diaphragm resonance extends the bandwidth and reduces distortion.

The diaphragm is driven by the motive force created when current passes through the conductor applied to the film within the magnetic field. The conductor on the electro-dynamic planar loudspeaker is attached directly to the diaphragm film. Accordingly, the conductor presents design challenges since it must be capable of carrying current and is preferably low in mass and securely attached to the film even at high power and high temperatures.

With the dimensional flexibility obtained with an electro-dynamic planar loudspeaker, various locations in automotive and non-automotive vehicles may be employed to house electro-dynamic planar loudspeakers. Different locations offer various advantages over other locations. The thin depth of the electro-dynamic planar loudspeaker allows it to fit where a conventional loudspeaker would not.

Other features affecting the acoustical characteristics of the electro-dynamic planar loudspeaker include the controlled directivity of the audible output from the loudspeaker. The acoustical directivity of the audible output of a loudspeaker is critical for good audio system design and performance and creates a positive acoustical interaction with the listeners in a listening environment.

The characteristic of directivity of a loudspeaker is the measure of the magnitude of the sound pressure level ("SPL") of the audible output from the loudspeaker, in decibels ("dB"), as it varies throughout the listening environment. The SPL of the audible output of a loudspeaker can vary at any given location in the listening environment depending on the direction angle and the distance from the loudspeaker of that particular location and the frequency of the audible output from the loudspeaker. The directivity pattern of a loudspeaker may be plotted on a graph called a polar response curve. The curve is expressed in decibels at an angle of incidence with the loudspeaker, where the on-axis angle is 0 degrees.

In FIG. 8, the directivity pattern of the audible output from a loudspeaker of a given physical size is shown to vary according to the direction away from the loudspeaker and the frequency of the audible output. In the low frequency range of approximately 1 kHz, the directivity of the loudspeaker is shown to be generally omni-directional. As the frequency of the audible output from the loudspeaker increases relative to the size of the loudspeaker, the polar response curve for the loudspeaker becomes increasingly directional. The increasing directivity of the loudspeaker at higher frequencies gives rise to off-axis lobes and null areas or nodes in the polar response curves. This phenomenon is referred to as "fingering" or "lobing."

An electro-dynamic planar loudspeaker exhibits a defined acoustical directivity pattern relative to its physical shape and the frequency of the audible output produced by the loudspeaker. Consequently, when an audio system is designed, loudspeakers possessing a desired directivity pattern over a given frequency range are selected to achieve the intended performance of the system. Different loudspeaker directivity patterns may be desirable for various loudspeaker applications. For example, for use in a consumer audio system for a home listening environment, a wide directivity may be preferred in order to cover a wide listening area. Conversely, a narrow directivity may be desirable to direct sounds such as voices, in only a predetermined direction in order to reduce room interaction caused by boundary reflections.

Often, however, space limitations in the listening environment prohibit the use of a loudspeaker in the audio system that possesses the preferred directivity pattern for the system's design. For example, the amount of space and the particular locations in a listening environment that are available for locating and/or mounting the loudspeakers of the audio system may prohibit including a particular loudspeaker that exhibits the directivity pattern intended by the system's designer. Also, due to the environment's space and location restraints, a loudspeaker may not be capable of being positioned or oriented in a manner that is consistent with the loudspeaker's directivity pattern. Consequently, the performance of the audio system in that environment cannot be achieved as intended. An example of such a listening environment is the interior passenger compartment of an automobile or other vehicle.

Because the directivity pattern of a loudspeaker generally varies with the frequency of its audible output, it is often desirable to control and/or enhance the directivity pattern of the loudspeaker to achieve a consistent directivity pattern over a wide frequency range of audible output from the loudspeaker.

Conventional direct-radiating electro-dynamic planar loudspeakers must be relatively large with respect to operating wavelength to have acceptable sensitivity, power handling, maximum sound pressure level capability and low-frequency bandwidth. Unfortunately, this large size results in a high-frequency beam width angle or coverage that may be too narrow for its intended application. The high-frequency horizontal and vertical coverage of a rectangular planar radiator is directly related to its width and height in an inverse relationship. As such, large radiator dimensions exhibit narrow high-frequency coverage and vice versa.

SUMMARY

The invention discloses a system to enhance, modify and/or control the acoustical directivity characteristic of an electro-dynamic planar loudspeaker. The acoustical directivity of a loudspeaker is modified through the use of an acoustic lens. The acoustic lens includes a body having a radiating acoustic aperture. The aperture extends through the body.

The acoustic lens may be positioned proximate the diaphragm of an electro-dynamic planar loudspeaker to modify the directivity pattern of the loudspeaker. The directivity pattern of the loudspeaker may be modified with the acoustic lens independent of the loudspeaker diaphragm orientation. In addition, the acoustical directivity of the loudspeaker may be modified by the acoustic lens regardless of the shape of the diaphragm of the loudspeaker.

The system may also effectively reduce the high-frequency radiating dimensions of a diaphragm included in a loudspeaker. The high-frequency radiating dimensions may be reduced to widen the high-frequency coverage of the loudspeaker without affecting other operating characteristics. Specifically, a directivity-modifying acoustic lens may be used to partially block radiating portions of a loudspeaker. The radiating portions may be partially blocked to effectively reduce the radiating dimensions of the diaphragm at high frequencies. In addition, the coverage or beam width angle of the diaphragm may be widened. At mid to low frequencies, the acoustic lens may have minimal effect on the loudspeaker sensitivity, power handling and maximum sound pressure level.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

FIGS. 1-4 illustrate a flat panel loudspeaker 100 that includes a frame 200, a plurality of high energy magnets 202 and a diaphragm 204. Frame 200 provides a structure for fixing magnets 202 in a predetermined relationship to one another. Magnets 202 may be positioned to define five rows of magnets 202 with three magnets in each row as illustrated. The rows are arranged with alternating polarity such that fields of magnetic flux are created between each row. Once the flux fields have been defined, diaphragm 204 may be fixed to frame 200 along its periphery.

Figure 4:
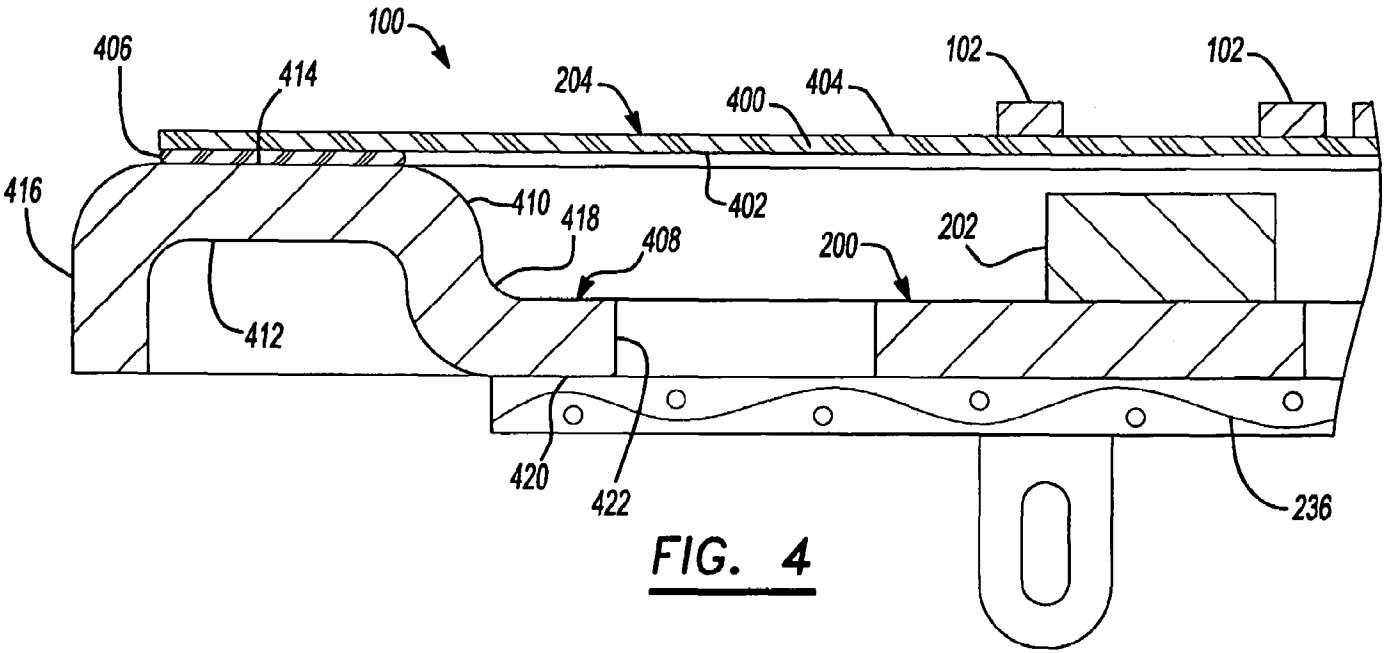
FIG. 4 is a detail cross-sectional view of the encircled area of FIG. 3.

FIG. 4 illustrates a diaphragm 204 that includes a thin film 400 having a first side 402 and a second side 404. First side 402 is coupled to frame 200. An adhesive 406, such as an adhesive that is curable by exposure to radiation may secure the film to the frame 200. To provide a movable membrane capable of producing sound, diaphragm 204 is mounted to the frame in a state of tension and is spaced apart a predetermined distance from magnets 202. The magnitude of tension of the diaphragm 204 may depend on the loudspeaker's physical dimensions, materials used to construct the diaphragm 204, and the strength of the magnetic field generated by magnets 202. Magnets 202 may be constructed from a highly energizable material such as neodymium iron boron ("NdFeB"). Thin film 400 may be a thin sheet, such as a polyethylenenaphthalate sheet having a thickness of approximately 0.001 inches. Materials such as polyester (known by the tradename "Mylar"), polyamide (known by the tradename "Kapton") and polycarbonate (known by the tradename "Lexan") may also be suitable for making the diaphragm 204.

Figure 1:
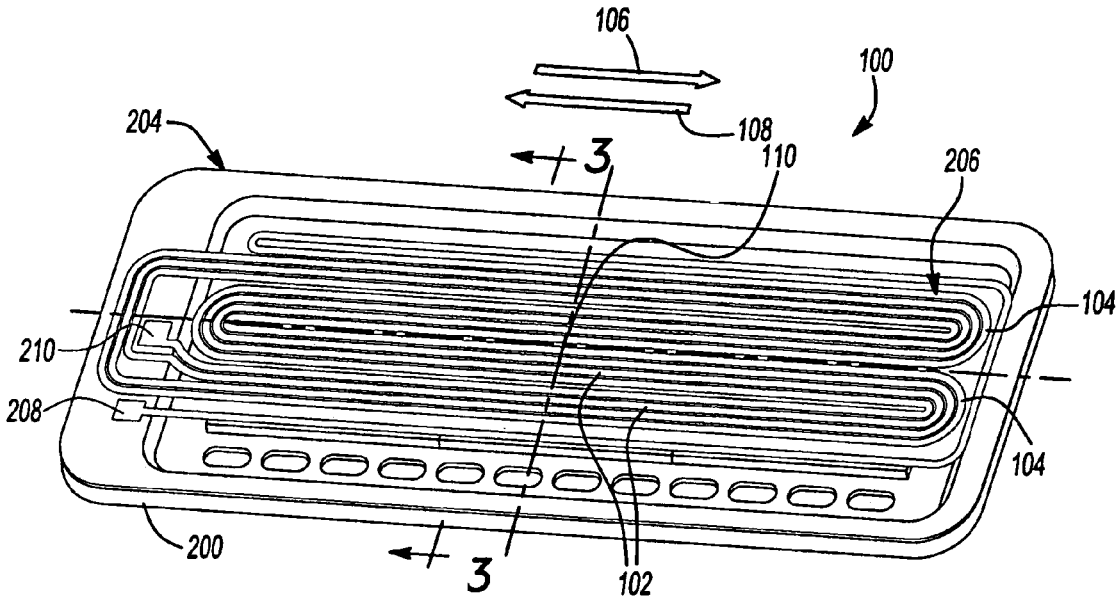
FIG. 1 is a perspective view of an electro-dynamic planar loudspeaker.
Figure 2:
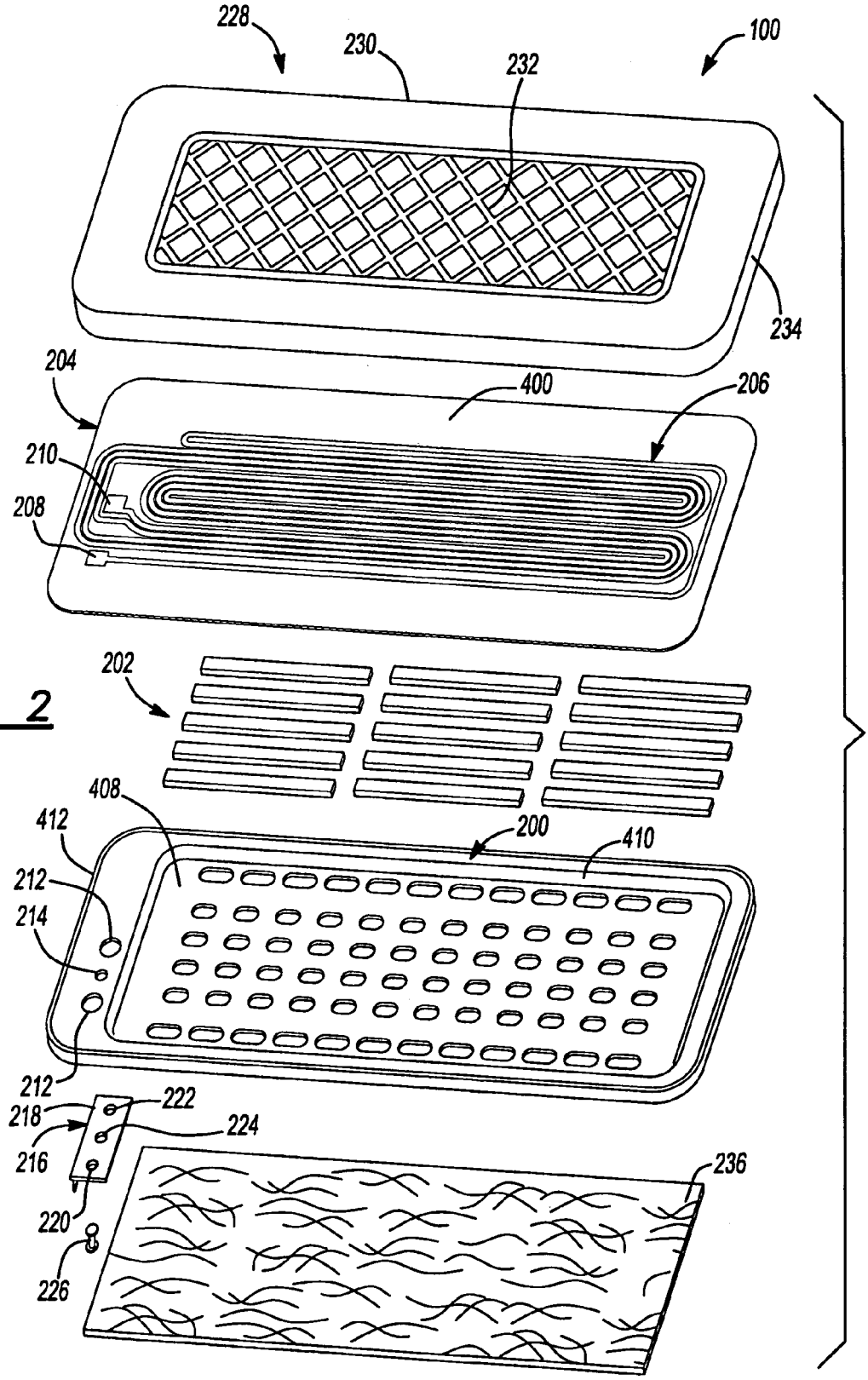
FIG. 2 is an exploded perspective view of the electro-dynamic planar loudspeaker shown in FIG. 1.

FIG. 2 shows a conductor 206 that is coupled to second side 404 of film 400. Conductor 206 may be formed as an aluminum foil bonded to film 400. Conductor 206 has a first end 208 and a second end 210 positioned adjacent one another at one end of the diaphragm 204. Conductor 206 is shaped in serpentine fashion having a plurality of substantially linear sections or traces 102 longitudinally extending along the film 400. The linear sections 102 may be interconnected by radii 104 to form a single current path, as best shown in FIG. 1.

Linear sections 102 are positioned within the flux fields generated by permanent magnets 202. The linear sections 102 that carry current in a first direction 106 are positioned within magnetic flux fields having similar directional polarization. Linear sections 102 of conductor 206 having current flowing in a second direction 108, opposite first direction 106, are placed within magnetic flux fields having an opposite directional polarization. Positioning the conductor portions 102 in this manner assures that a driving force is generated by the interaction between the magnetic fields developed by magnets 202 and the magnetic fields developed by current flowing in conductor 206. As such, an electrical input signal traveling through conductor 206 causes mechanical motion of diaphragm 204 thereby producing an acoustical output.

Figure 3:
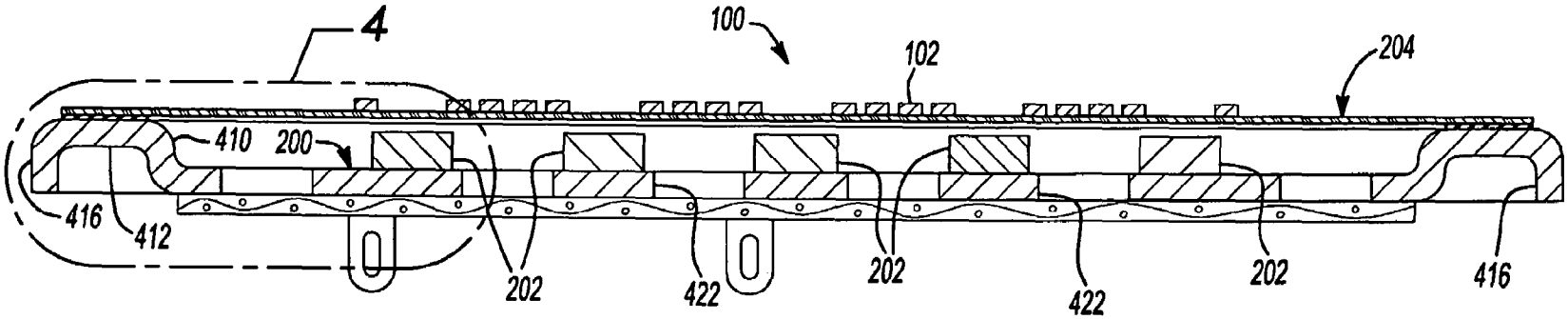
FIG. 3 is a cross-sectional view taken along line 3-3 of FIG. 1.

FIG. 4 illustrates a frame 200 that is a generally dish-shaped member that may be constructed from a substantially planar contiguous steel sheet. Frame 200 includes a recessed portion or base plate 408 surrounded by a wall 410. The wall 410 may extend generally orthogonally from the base plate 408 as best seen in FIGS. 2-4. Wall 410 terminates at a radially extending flange 412 that defines a substantially planar mounting surface 414, as best shown in FIG. 4. A lip 416 extends downwardly from flange 412 in a direction substantially parallel to wall 410. Base plate 408 is offset from planar mounting surface 414 and is recessed relative to diaphragm 204. Base plate 408 includes a first surface 418, a second surface 420 and a plurality of apertures or vent holes 422. The apertures 422 extend through the base plate 408. Apertures 422 are positioned and sized to provide passageways for air positioned between first side 402 of diaphragm 204 and first surface 418 of frame 200 to travel. As best shown in FIG. 2, frame 200 includes apertures 212 and 214 extending through flange 412 to provide clearance and mounting provisions for a conductor assembly 216.

Conductor assembly 216 includes a terminal board 218, a first terminal 220 and a second terminal 222. Terminal board 218 includes a mounting aperture 224. Terminal board 218 may be constructed from an electrically insulating material such as plastic or fiberglass. A pair of rivets or other connectors (not shown) may pass through apertures 212 to electrically couple first terminal 220 to first end 208 and second terminal 222 to second end 210 of conductor 206. A fastener such as a rivet 226 extends through apertures 224 and 214 to couple conductor assembly 216 to frame 200.

A grille 228 may be used to protect the diaphragm 204 from contact with objects inside the listening environment. The grill 228 may include a flat body 230 having a plurality of openings 232. A rim 234 may be located along the perimeter of the body 230. The frame 200 of the grill 228 may be attached and secured to the rim 234.

An acoustical dampener 236 is mounted to second surface 420 of frame base plate 408. Dampener 236 serves to dissipate acoustical energy generated by diaphragm 204 and minimize undesirable amplitude peaks during operation. The dampener 236 may be made from felt that is gas permeable to allow air to flow through dampener 236.

Figure 5:
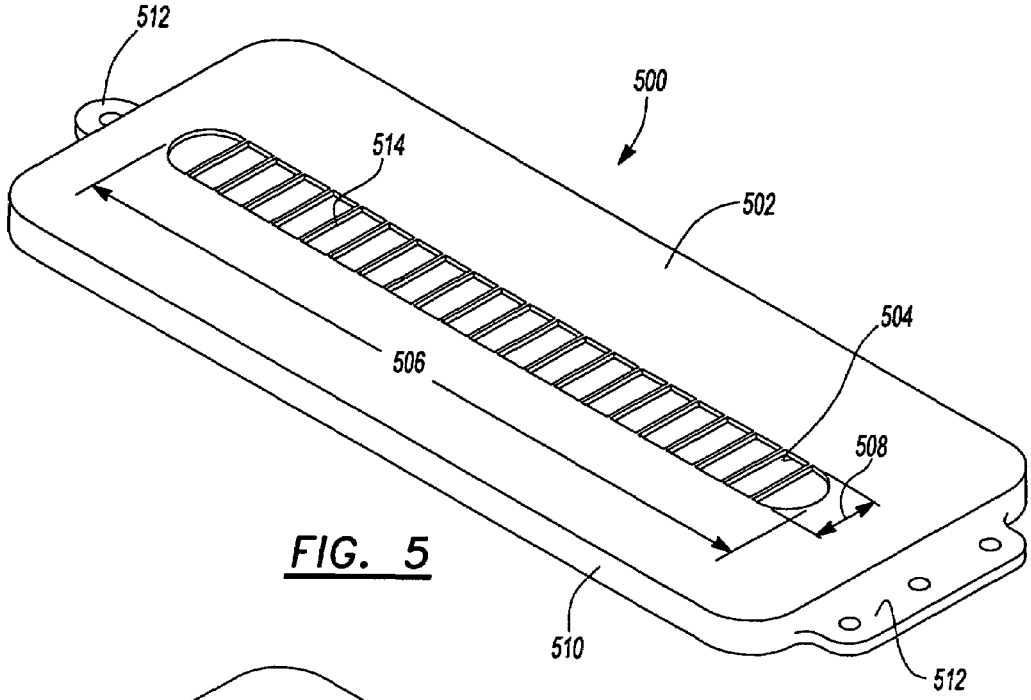
FIG. 5 is a perspective view of an acoustic lens.
Figure 6:
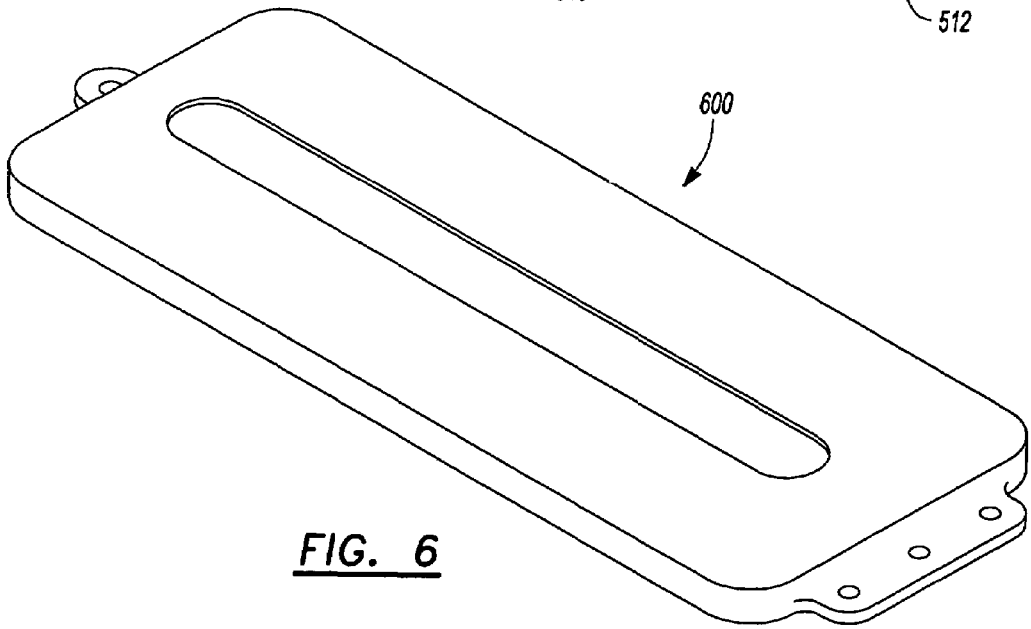
FIG. 6 is a perspective view of another acoustic lens similar to the lens of FIG. 5 shown without reinforcing ribs.
Figure 7:
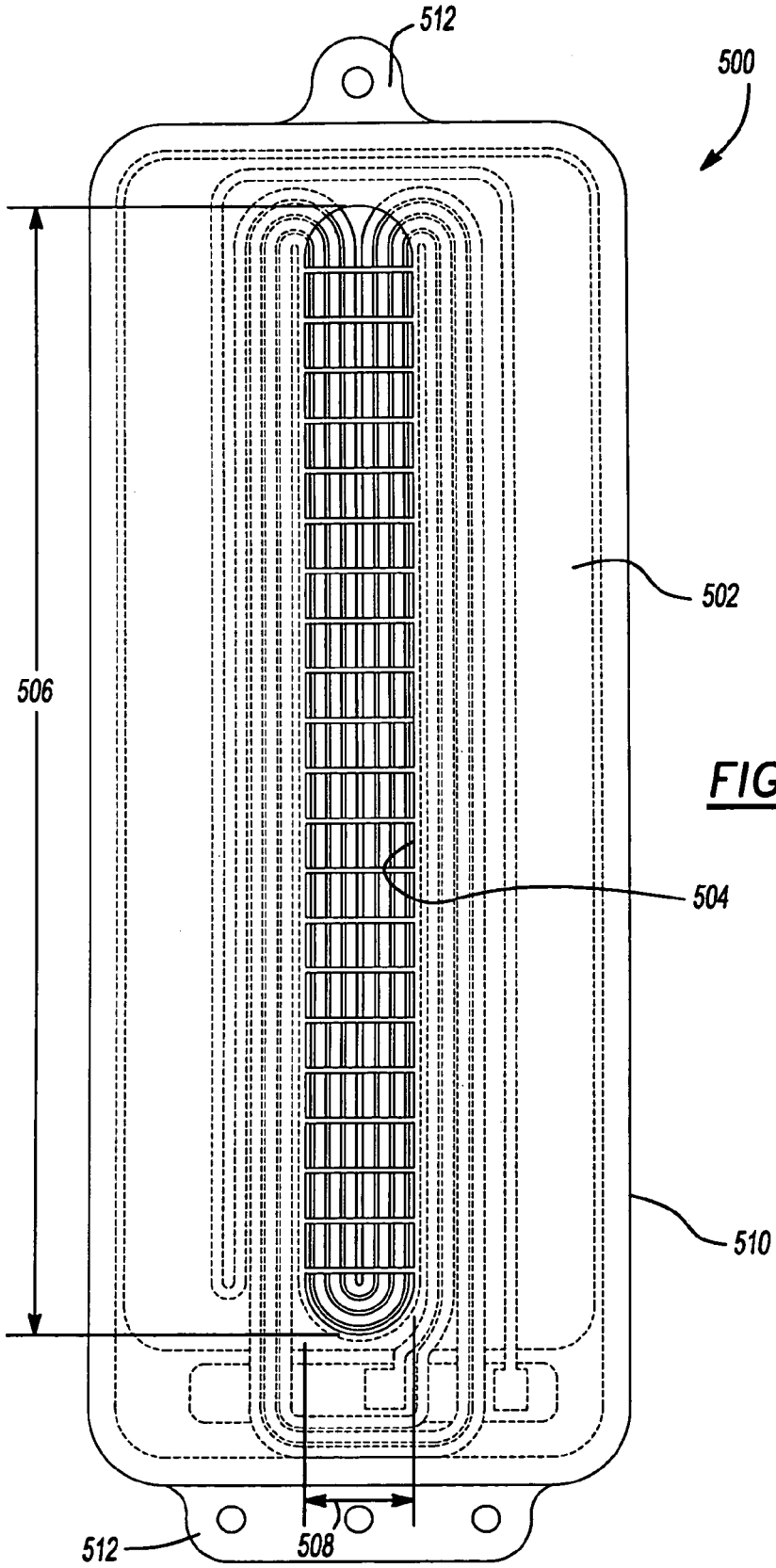
FIG. 7 is a front view of an electro-dynamic planar loudspeaker having an acoustic lens.

FIGS. 5-7 illustrate another example of a flat panel loudspeaker. Directivity modification is achieved by positioning an acoustic lens or panel 500 proximate diaphragm 204. Acoustic lens 500 includes a substantially planar body 502 having a radiating acoustic aperture 504 extending through the body 502. Aperture 504 is substantially shaped as an elongated slot having a length 506 and a width 508. A lip 510 extends about the perimeter of body 502 and is selectively engageable with a portion of frame 200. As such, body 502 of acoustic lens 500 is positioned proximate to and spaced apart from diaphragm 204. Body 502 may extend substantially across the entire surface area of diaphragm 204. Acoustic lens 500 may function similarly to previously described grille 228 or may be positioned between diaphragm 204 and grille 228. Body 502 may be constructed from a substantially acoustically opaque material such as injection molded thermoplastic. Acoustic lens 500 may also include a plurality of flanges 512 to mount acoustic lens 500 within a desired environment. Furthermore, acoustic lens 500 may include a plurality of ribs 514 to provide structural rigidity to the lens. FIG. 6 depicts an acoustic lens 600 substantially similar to lens 500 without reinforcing ribs 514. Lenses 500 and 600 may function substantially similar to one another.

Figure 8:
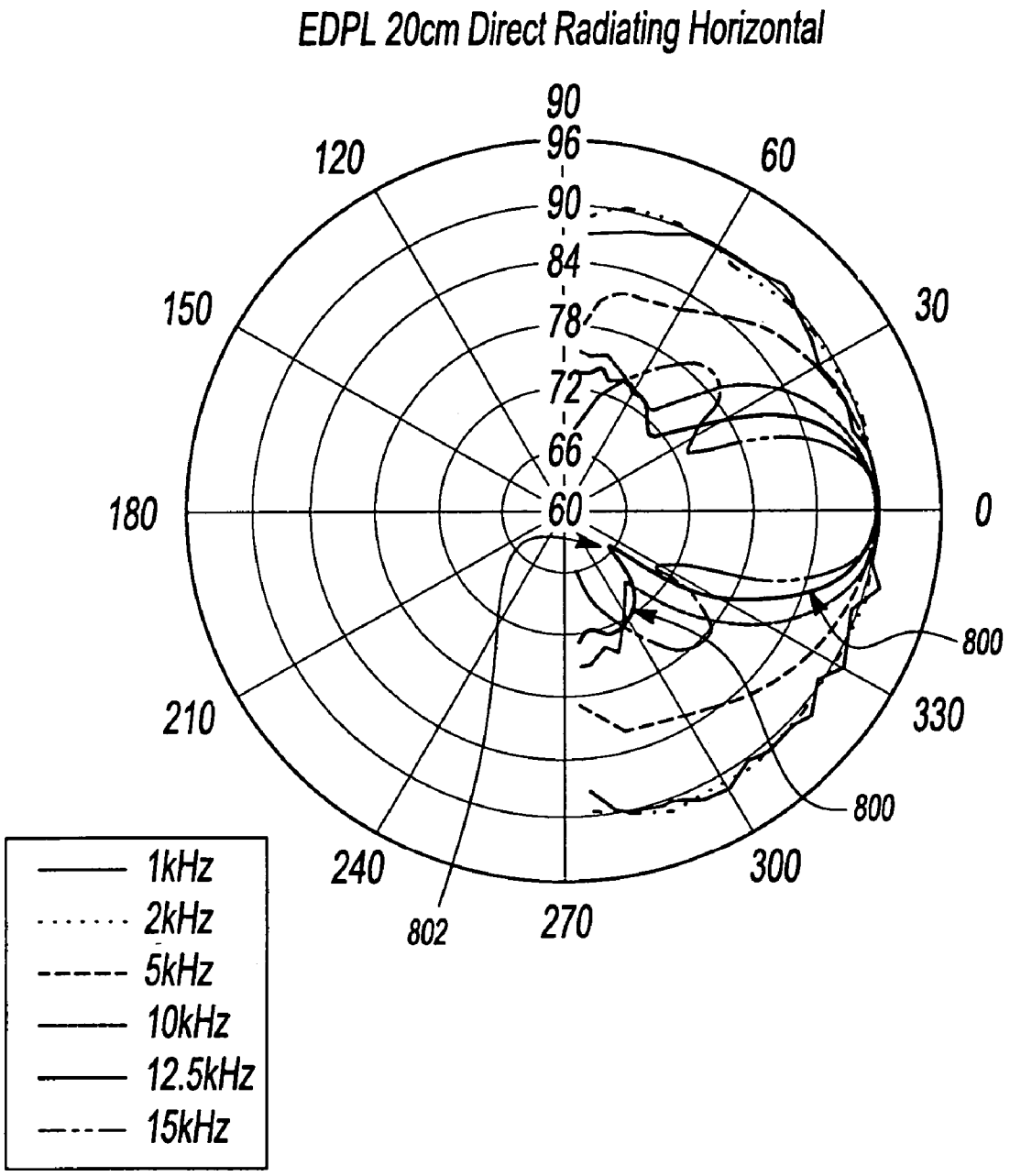
FIG. 8 is a polar response graph depicting the directivity of a direct radiating electro-dynamic planar loudspeaker.
Figure 9:
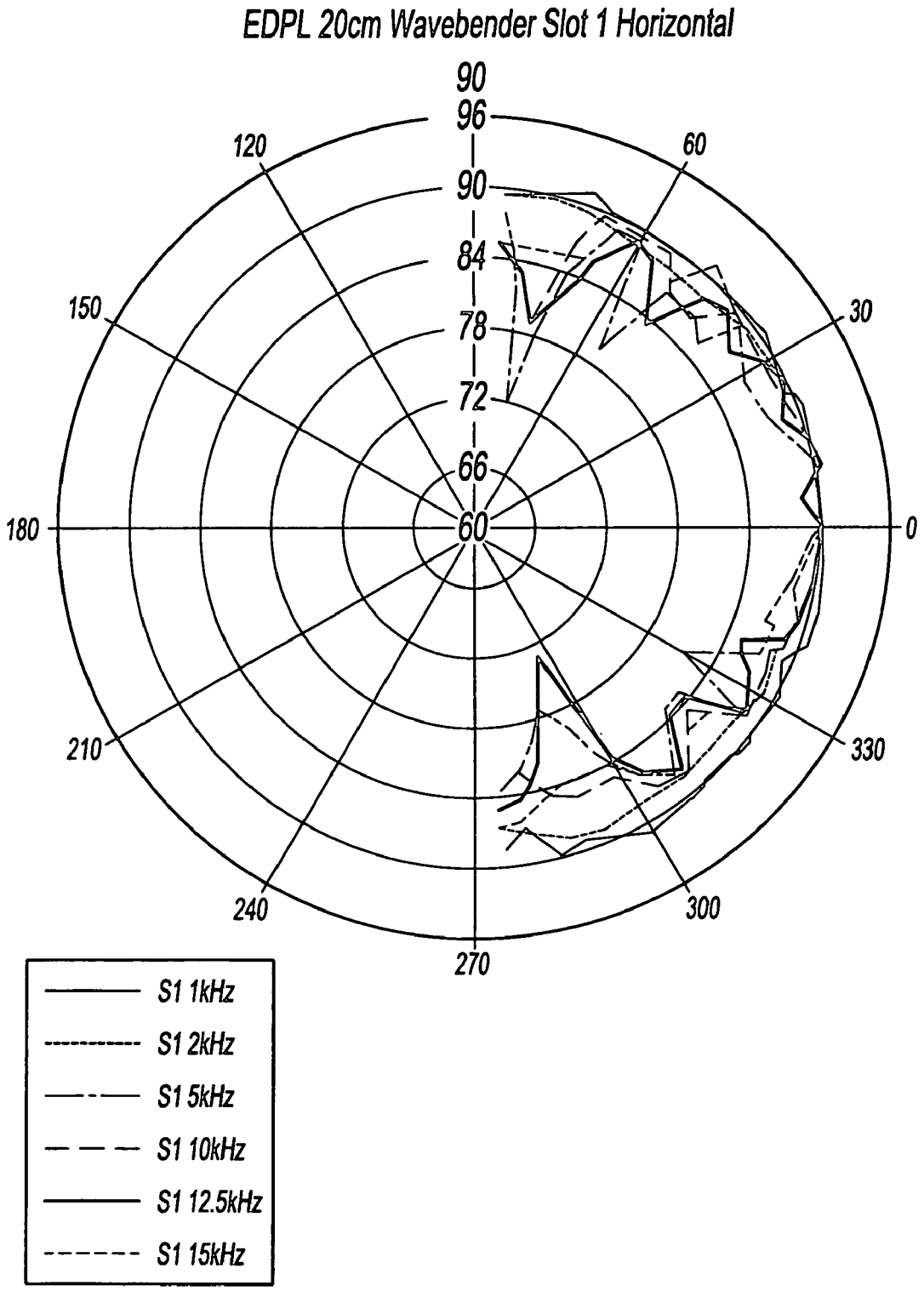
FIG. 9 is a polar response graph of the loudspeaker of FIG. 6 equipped with an acoustic lens.
Figure 10:
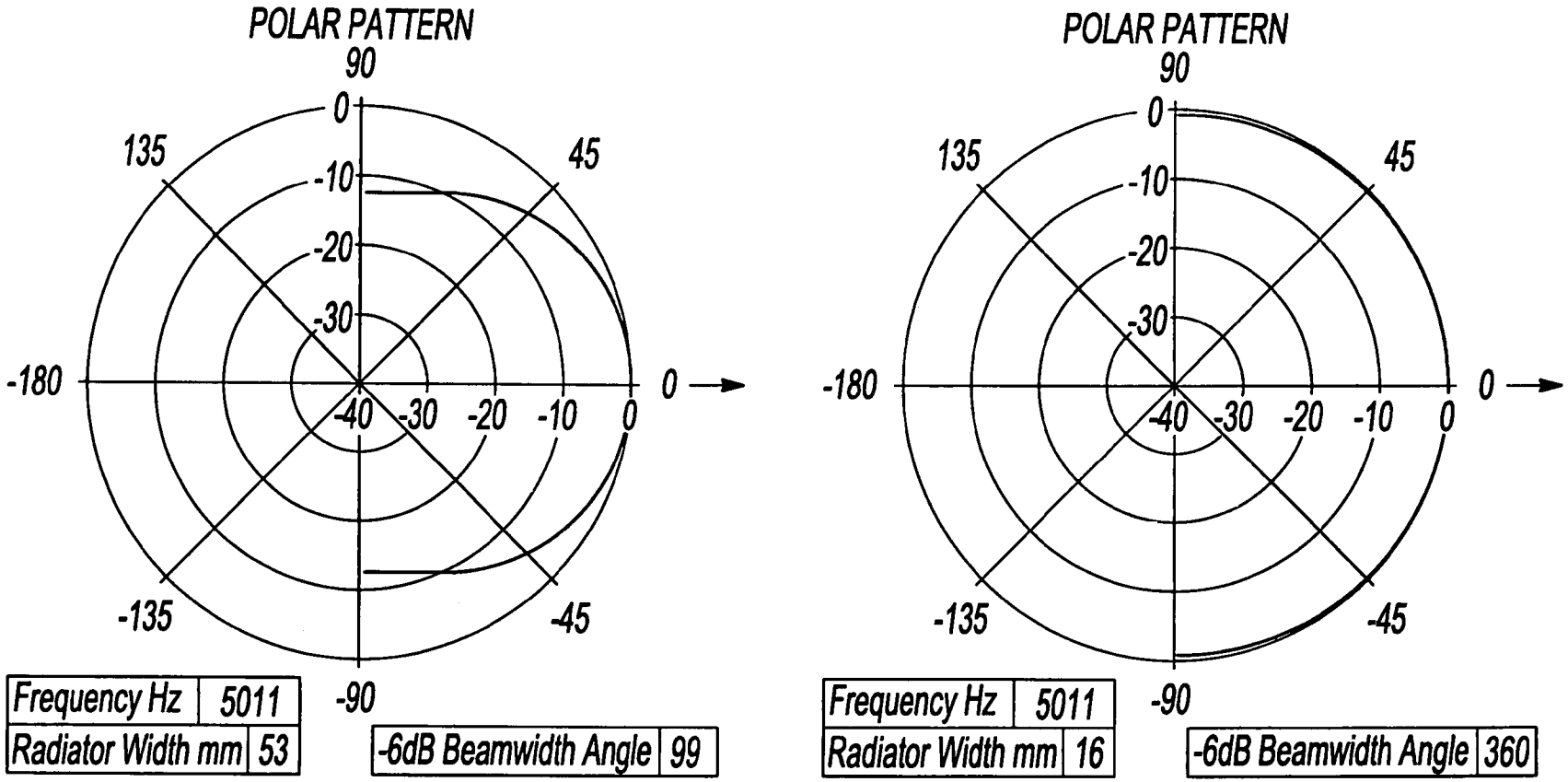
FIGS. 10-16 are polar response graphs at a variety of frequencies comparing the output of an electro-dynamic planar loudspeaker with the output of the same electro-dynamic planar loudspeaker equipped with an acoustic lens.
Figure 11:
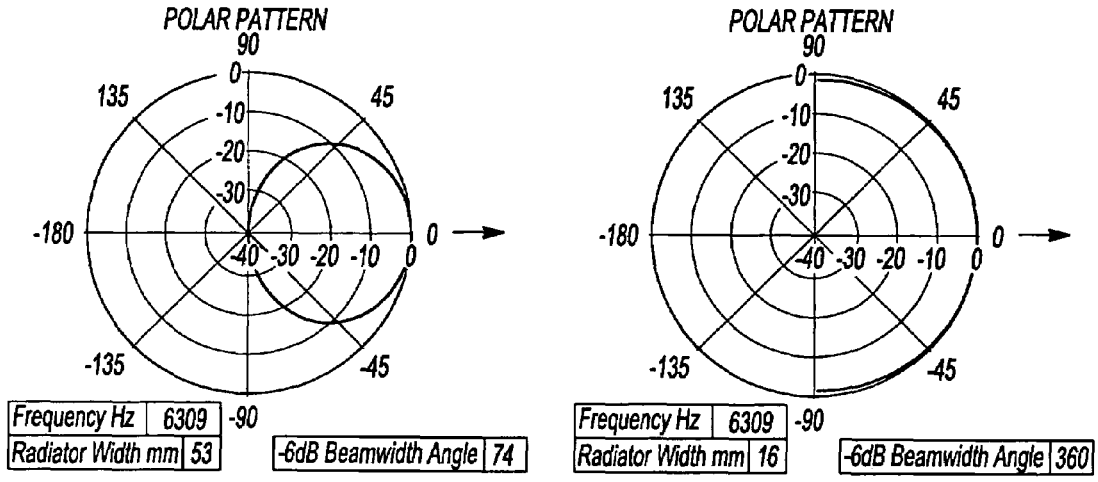
Figure 12:
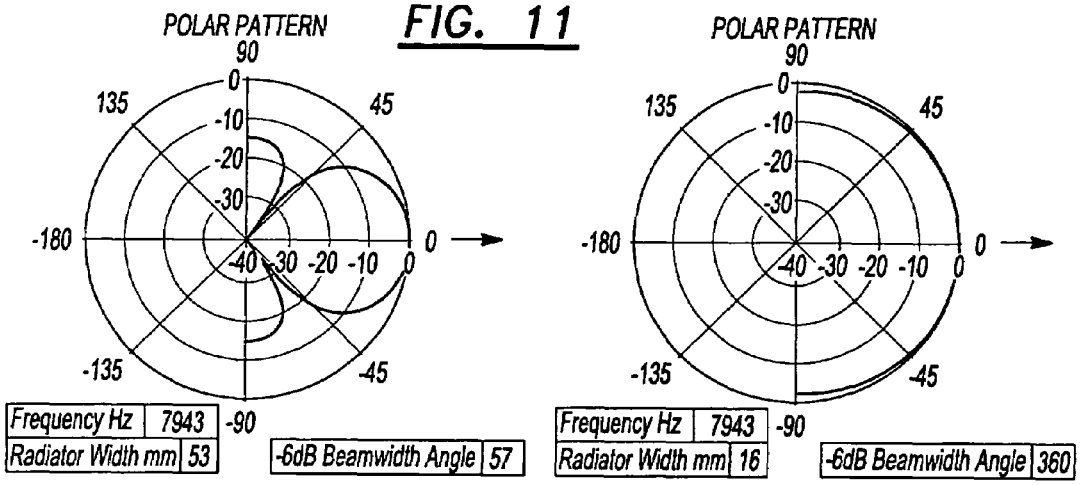
Figure 13:
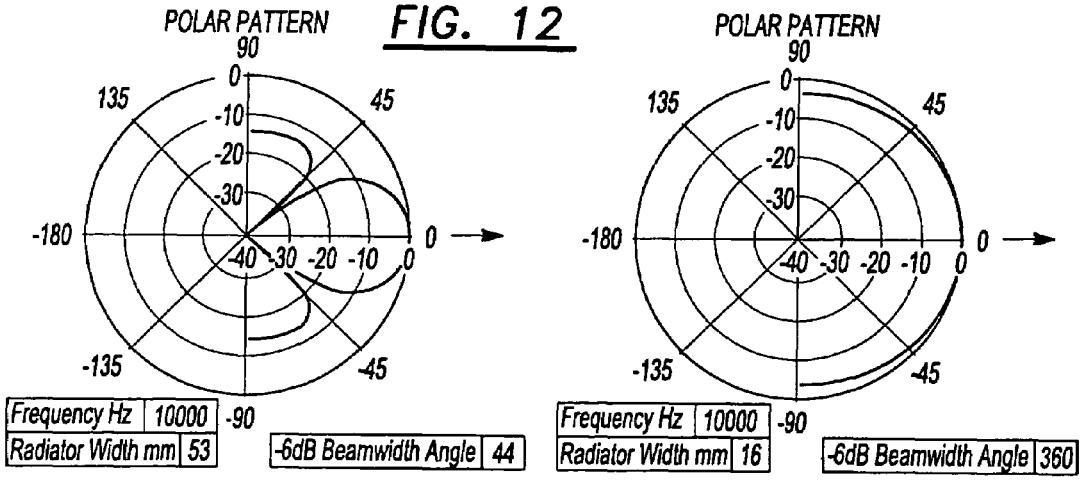
Figure 14:
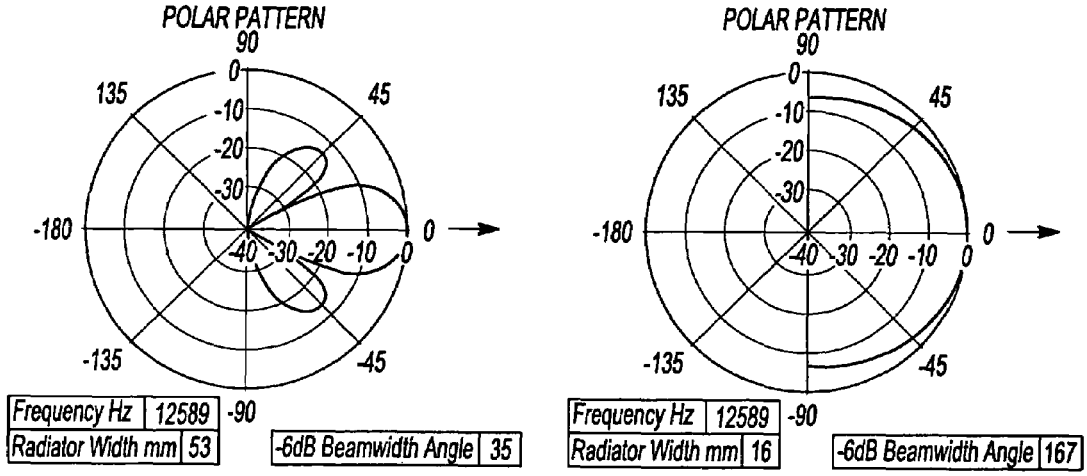
Figure 15:
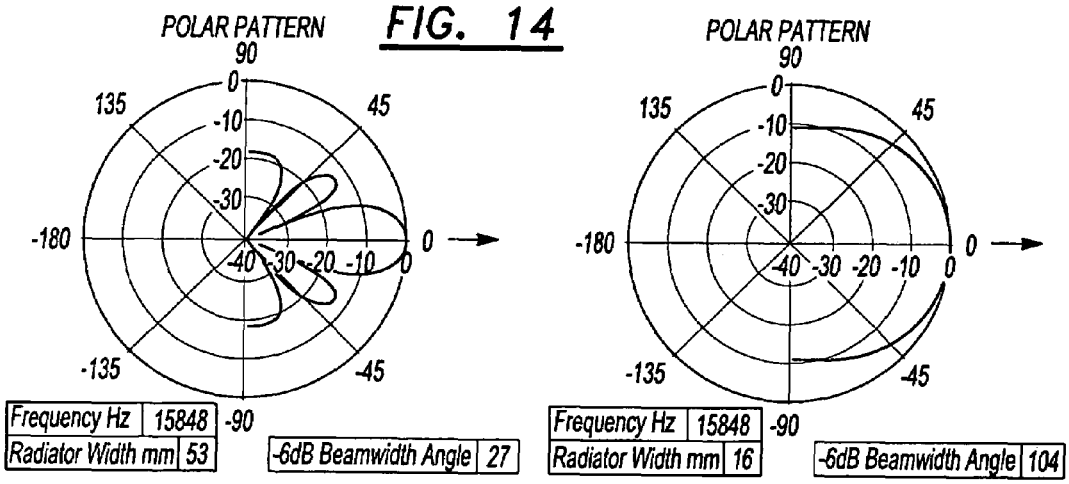
Figure 16:
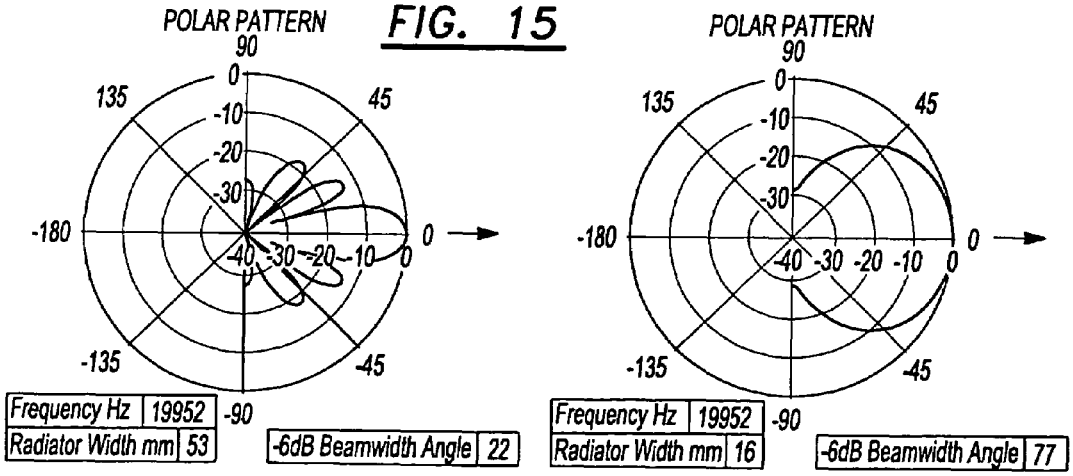

FIG. 8 depicts the horizontal polar response curve of an example electro-dynamic planar loudspeaker. FIG. 9 depicts the horizontal polar response of the electro-dynamic planar loudspeaker shown in FIG. 8, but with acoustic lens 500 positioned in front of the diaphragm. As a basis for comparison, loudspeaker 100 exhibits a radiating diaphragm width of approximately 53 millimeters. Directivity of the loudspeaker without an acoustic lens narrows with increased frequency. In the illustrated example, the directivity of the loudspeaker is shown to be generally omni-directional at approximately 1 kHz. The directivity begins to narrow at approximately 5 kHz. The increasing directivity of the loudspeaker at higher frequencies gives rise to off-axis lobes 800 and null areas or nodes 802 in the polar response curves.

With acoustic lens 500 positioned proximate diaphragm 204, the width 508 of elongated acoustic aperture 504 defines the effective radiating aperture width of loudspeaker 100. In the example shown, the aperture width and radiating width are 16 millimeters in size. As shown in FIG. 9, the directivity of the loudspeaker equipped with acoustic lens 500 does not begin to narrow until the frequency is greater than 12 kHz. Furthermore, the radiating width is relatively wide at 15 kHz. It should be appreciated that the shape and size of the loudspeaker 100 and the radiating aperture of lens 500 are merely exemplary and are not intended to limit the scope of the invention. For example, the directivity of a loudspeaker equipped with a lens having an aperture width of approximately 20 millimeters begins to narrow at about 9.6 kHz. An aperture width of approximately 12 millimeters exhibits a directivity narrowing at about 16 kHz.

For a more detailed analysis of lens 500 having a 16 millimeter width, FIGS. 10 through 16 present side by side horizontal polar response graphs of a direct radiating electro-dynamic planar loudspeaker and the same loudspeaker with acoustic lens 500 positioned adjacent its diaphragm. In FIGS. 8 through 14, beam width angle is represented as the angle in which the sound pressure level decreases no more than 6 decibels from the on axis amplitude. Accordingly, acoustic lens 500 may effectively reduce the radiating area of the loudspeaker diaphragm at high frequencies and thus widen the angular range in which maximum sound pressure level is maintained. At mid to low frequencies, lens 500 has a minimal effect on loudspeaker sensitivity, power handling and maximum sound pressure level.

The directivity pattern of a loudspeaker may be defined by the dimensions of the radiating area of its diaphragm, or in the case of a lens, the dimensions of the radiating acoustic aperture. Equation 1 defines the acoustic pressure at a specified distance and angle from a point 110 at the middle of diaphragm 204 relative to the width or length dimension of the radiating area.

$$p = p_0 \left| \frac{\sin\left[\left(\frac{\pi d}{\lambda}\right)\sin(\theta)\right]}{\left(\frac{\pi d}{\lambda}\right)\sin(\theta)} \right| \qquad \text{Equation 1}$$

Where:

d=The length of the radiating area

θ=Angle from a point 110 at the middle of the radiating surface to an observation point on a plane normal to the radiating surface and parallel to d $\rho_o$=Magnitude of the rms sound pressure at a distance r from the array at an angle θ=0

λ=Wavelength

Figure 17:
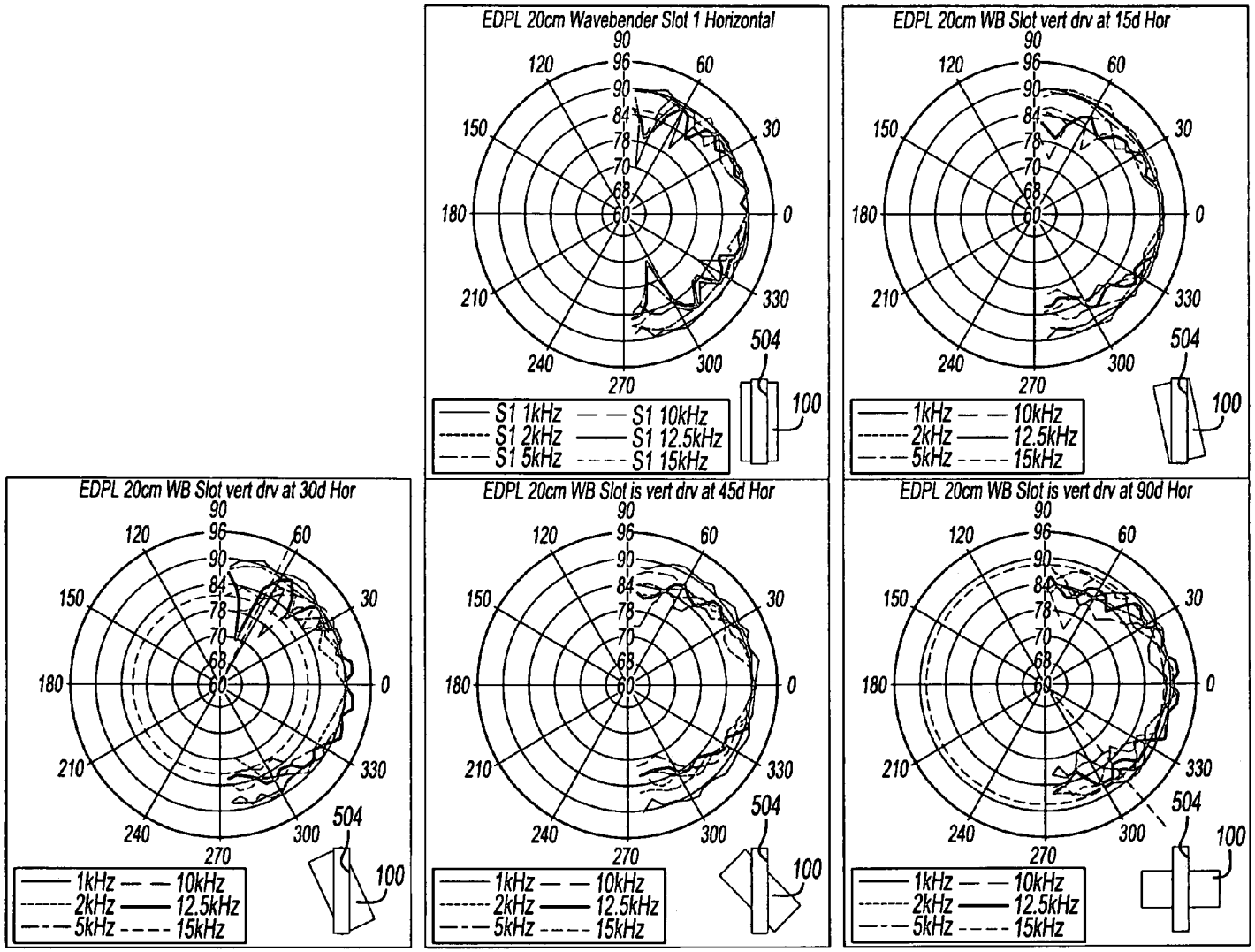
FIG. 17 is a series of polar response plots where the loudspeaker is rotated relative to the acoustic aperture.
Figure 18:
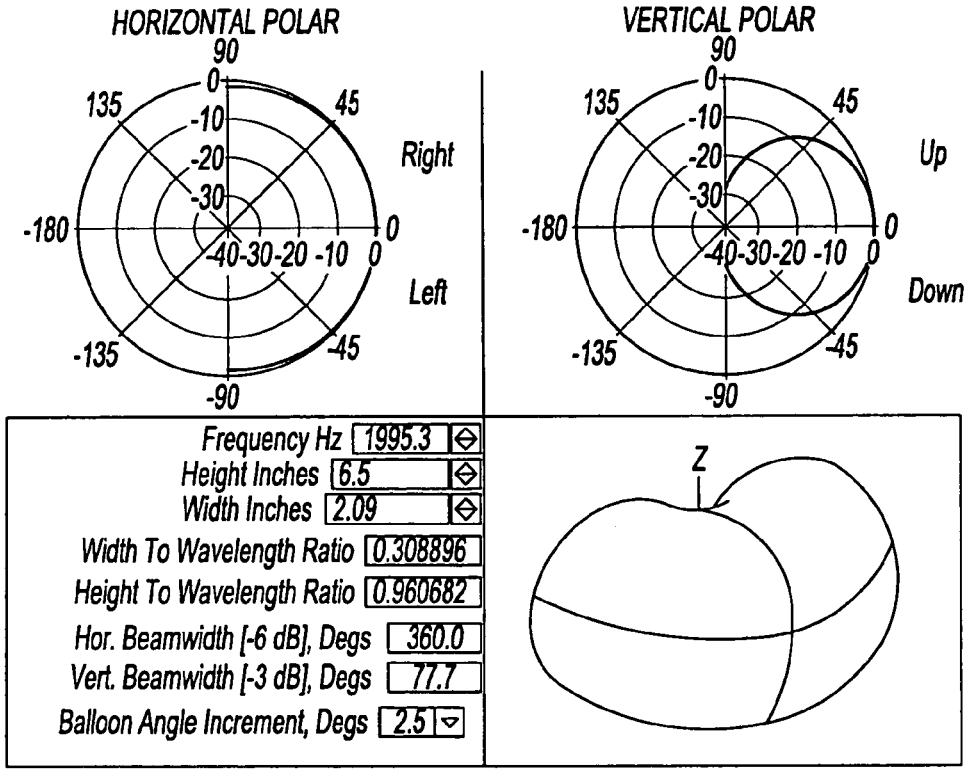
FIGS. 18-27 depict horizontal polar, vertical polar and spherical response plots comparing the output of an electro-dynamic planar loudspeaker with the output of the same electro-dynamic planar loudspeaker equipped with an acoustic lens at a variety of frequencies.
Figure 19:
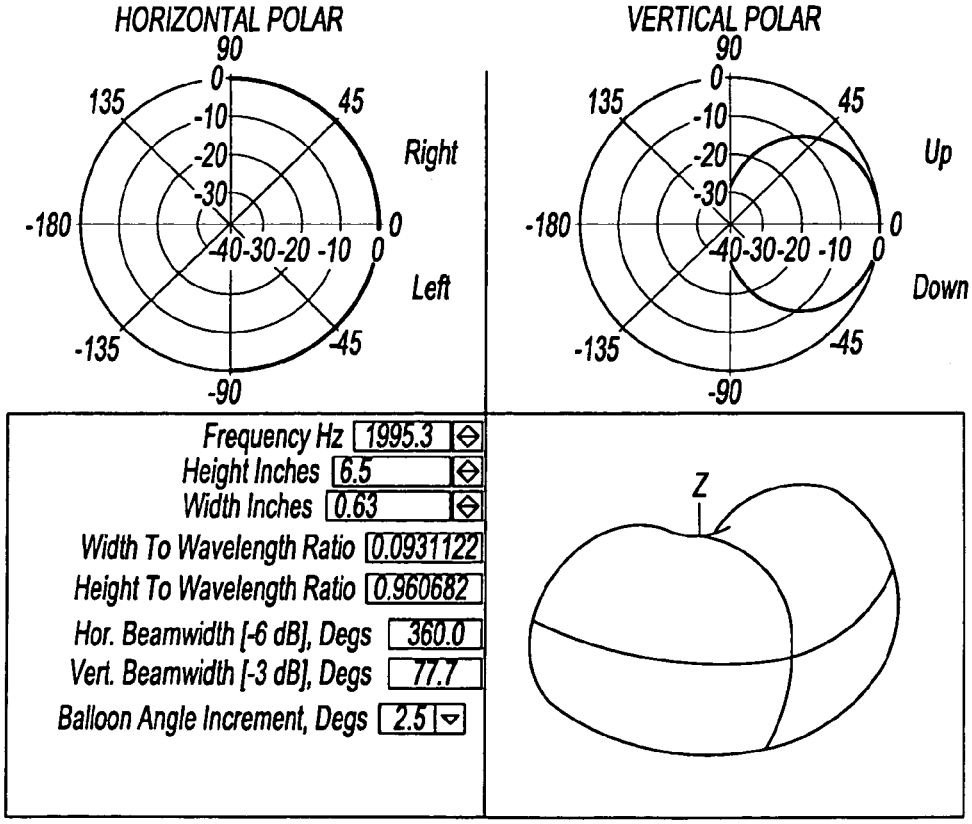
Figure 20:
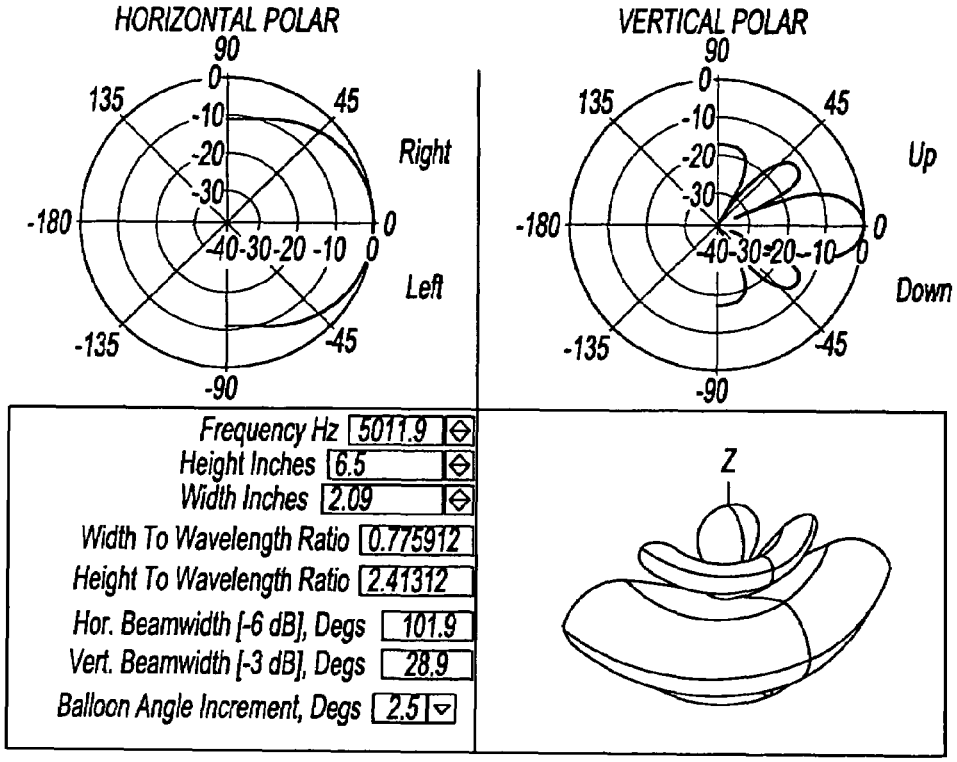
Figure 21:
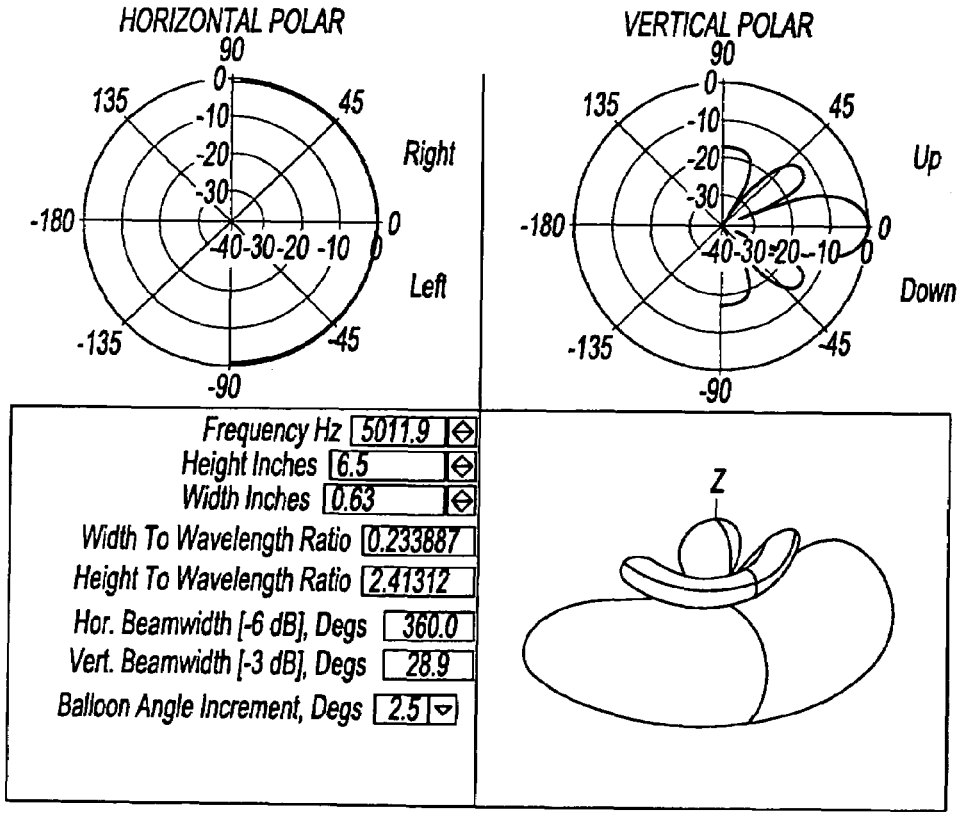
Figure 22:
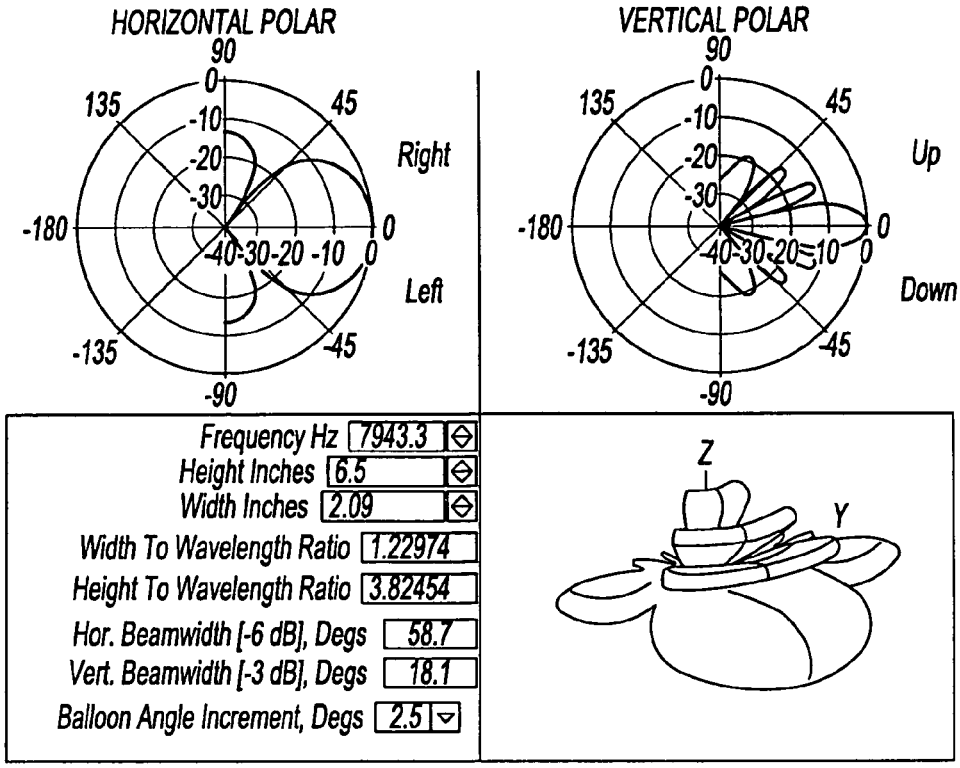
Figure 23:
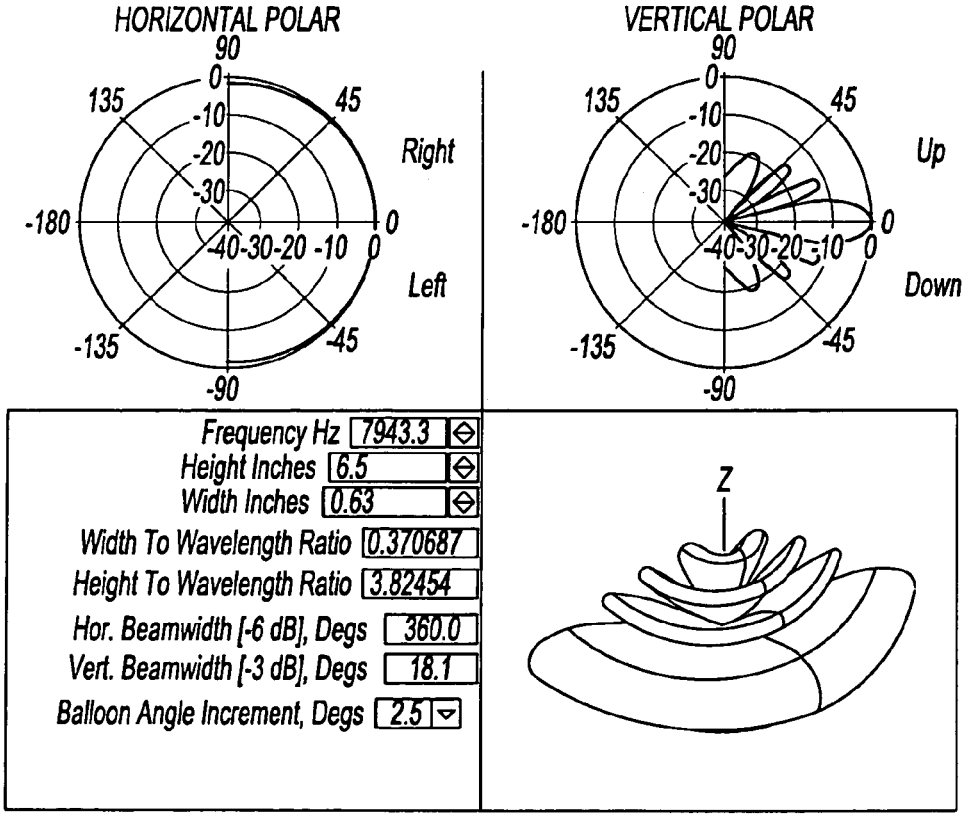
Figure 24:
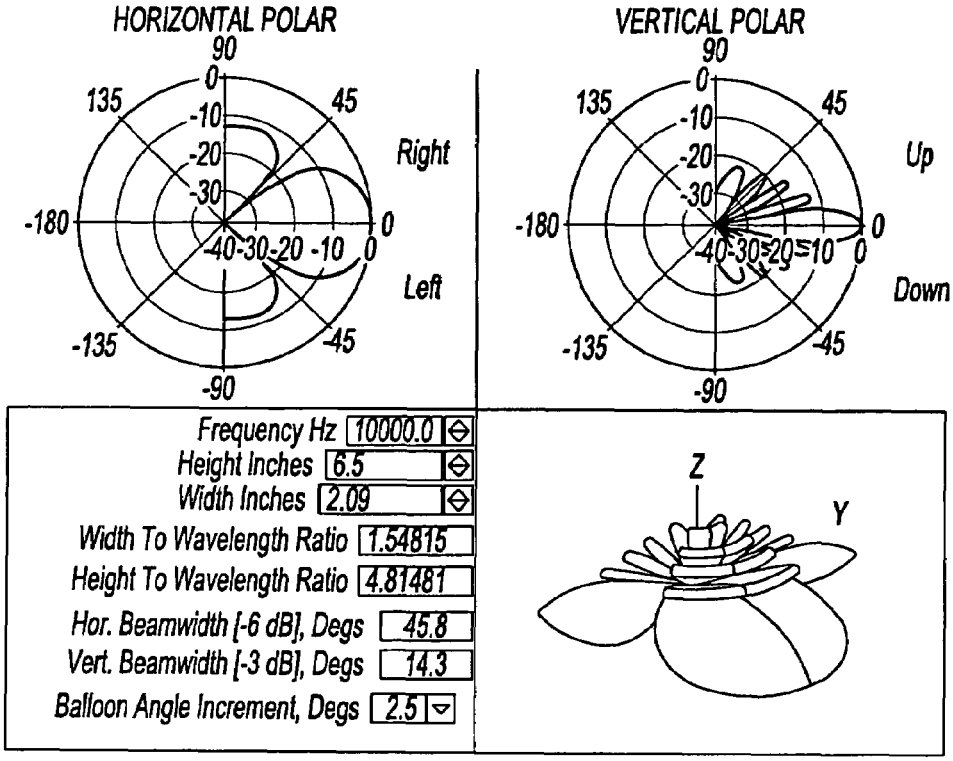
Figure 25:
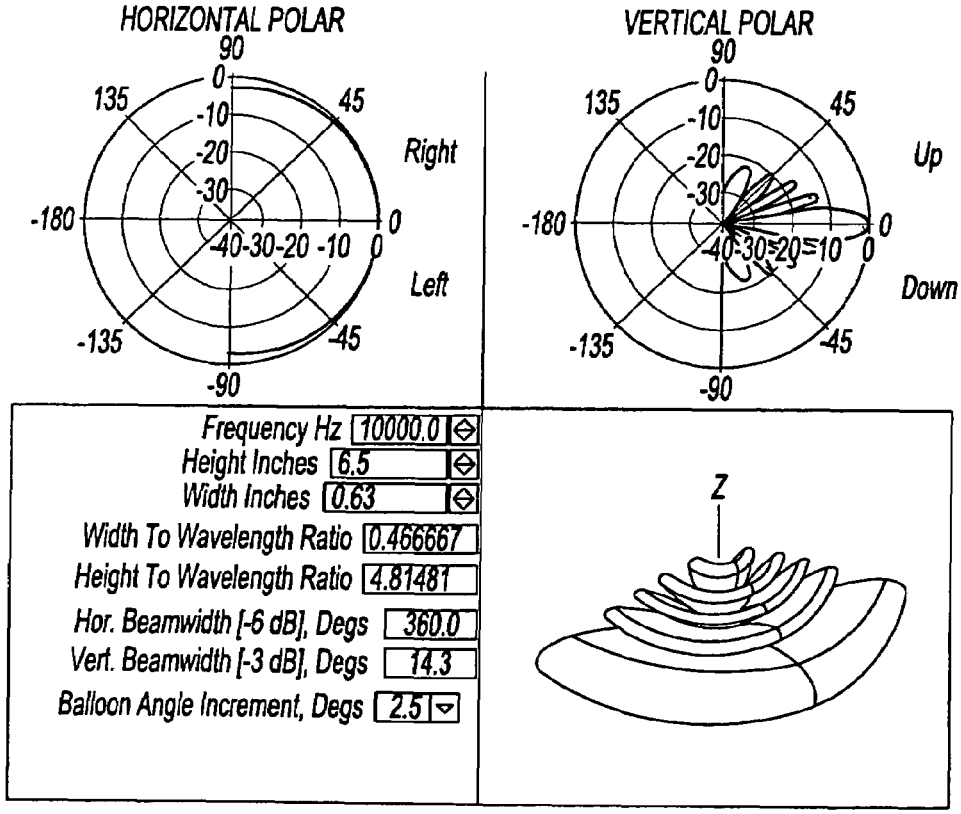
Figure 26:
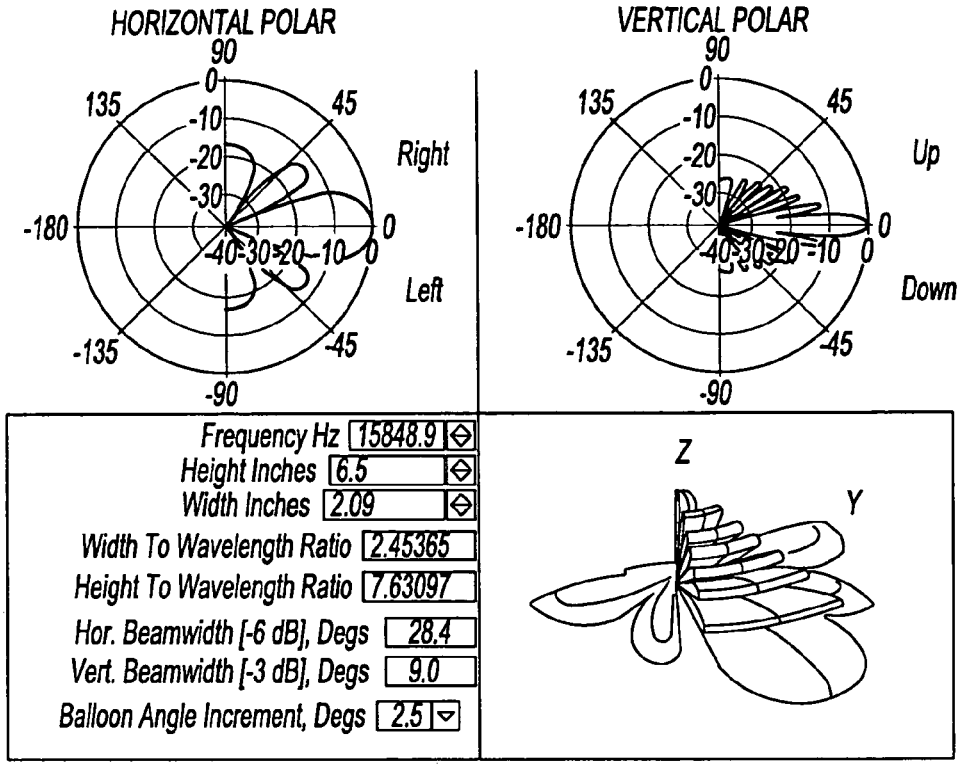

FIG. 17 illustrates that the directivity modification may be dominated by the size, shape and orientation of the aperture extending through the acoustic lens. This is demonstrated by rotating electro-dynamic planar loudspeaker 100 while maintaining the position of acoustic aperture 504 relative to measuring equipment. Each of the five polar response graphs shown corresponds to a different angular position of loudspeaker 100. As the graphs indicate, the directivity remains virtually constant regardless of loudspeaker angular orientation. Accordingly, successful directivity modification may be achieved by appropriately sizing and positioning an acoustic aperture proximate a diaphragm of a loudspeaker. The physical size and shape of a driver included in the loudspeaker to drive the diaphragm may provide little to no contribution to directivity control when used in conjunction with an acoustic lens. Therefore, modification of the directivity of a loudspeaker may be accomplished by placing an acoustic lens in proximity to the diaphragm of the loudspeaker.

Figure 27:
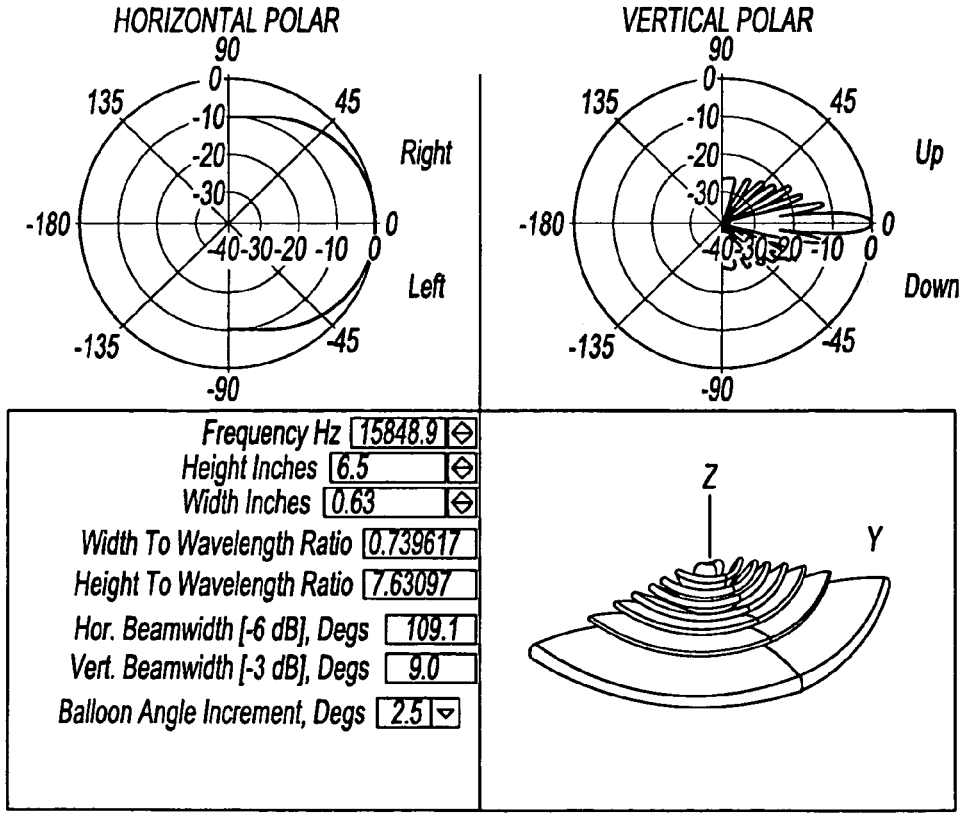

The three dimensional directivity pattern of an electro-dynamic planar loudspeaker may also be modeled. Equation 2 models the directivity pattern for a rectangular radiator in an infinite baffle.

$$p = p_o \left| \frac{\sin\left[\left(\frac{\pi d_1}{\lambda}\right)\sin(\theta_1)\right]}{\left(\frac{\pi d_1}{\lambda}\right)\sin(\theta_1)} \cdot \frac{\sin\left[\left(\frac{\pi d_2}{\lambda}\right)\sin(\theta_2)\right]}{\left(\frac{\pi d_2}{\lambda}\right)\sin(\theta_2)} \right| \qquad \text{Equation 2}$$

where:

$d_1$=The length of the radiating area $d_2$=The width of radiating area $\theta_1$=Angle from middle of radiating surface to observation point on plane normal to radiating surface and parallel to $d_1$ $\theta_2$=Same as $\theta_1$ with $d_2$ substituting for $d_1$ $\lambda$=Wavelength FIGS. 18-27 depict horizontal polar, vertical polar and spherical response plots at a variety of frequencies. The Figures compare the output of an electro-dynamic planar loudspeaker with the output of the same electro-dynamic planar loudspeaker equipped with acoustic lens 500. Specifically, FIGS. 18, 20, 22, 24 and 26 represent the output of an electro-dynamic planar loudspeaker having a rectangular diaphragm with the dimensions of approximately 165 mm×53 mm. FIGS. 19, 21, 23, 25 and 27 represent the output of the same loudspeaker equipped with acoustic lens 500 of the invention having a 165 mm long×16 mm wide slot extending therethrough. The 53 mm wide radiating diaphragm develops a narrowing horizontal directivity beginning at approximately 5 kHz. The loudspeaker equipped with the acoustic lens having a 16 mm wide radiating aperture maintains wide horizontal directivity up to 16 kHz. FIG. 27 shows a polar response where the horizontal directivity is greater than 100 degrees at about 16 kHz. The vertical directivity for both of the devices remains similar to each other while narrowing with increasing frequency.

Furthermore, use of the previously discussed system may allow the construction of a variety of acoustic lenses tailored to modify the directivity of predetermined frequency ranges. It should also be appreciated that the previously discussed acoustic lens may be constructed from any number of materials including fabric, metal, plastic, composites or other suitable material.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. An electro-dynamic planar loudspeaker, comprising:

a frame;

a plurality of rows of at least three magnets each mounted to the frame;

a diaphragm secured to the frame with an acoustic dampener mounted on the frame opposite the diaphragm; and a thermoplastic acoustic lens positioned proximate to and spaced apart from the diaphragm, where the acoustic lens includes a single aperture that extends substantially linearly through the acoustic lens to modify the directivity pattern of the loudspeaker, wherein a thickness of the acoustic lens is less than a distance between the acoustic lens and the diaphragm;

where the aperture is substantially rectangularly shaped with a width ranging between about 12 millimeters and about 20 millimeters and a length substantially equal to a length of the diaphragm.

2. The electro-dynamic planar loudspeaker of claim 1 where the acoustic lens is configured to modify the directivity pattern of the electro-dynamic planar loudspeaker to increase the angular range at which at least a predetermined sound pressure level is maintained.

3. The electro- dynamic planar loudspeaker of claim 2 where the sound pressure level at a predetermined distance from the diaphragm varies less than about six decibels within an angular range.

4. The electro.-dynamic planar loudspeaker of claim 2 where a beam width angle is greater than 100 degrees at frequencies up to about 16 kHz.

5. The electro-dynamic planar loudspeaker of claim 1 where the acoustic lens is configured to modify the directivity pattern of the electro-dynamic planar loudspeaker to substantially reduce the number of lobes, at high frequencies, within a listening environment by effectively reducing radiating area of the diaphragm for high frequency sound waves.

6. The electro-dynamic planar loudspeaker of claim 1 where the acoustic lens is configured to modify the directivity pattern of the electro-dynamic planar loudspeaker to reduce the number of lobes, at high frequencies, in a plane normal to the diaphragm by effectively reducing radiating area of the diaphragm for high frequency sound waves.

7. The electro-dynamic planar loudspeaker of claim 1 where the frame includes a recessed portion and where the diaphragm is spaced apart from the recessed portion of the frame.

8. The electro-dynamic planar loudspeaker of claim 7 where the recessed portion includes having a plurality of vent holes extending through the frame.

9. The electro-dynamic planar loudspeaker of claim 1 where the aperture is shaped as a slot.

10. The electro-dynamic planar loudspeaker of claim 9 where the slot has a width of about 16 millimeters.

11. The electro-dynamic planar loudspeaker of claim 1 where a ratio of diaphragm width to aperture width ranges from 2:1 through to 6:1.

12. An electro-dynamic planar loudspeaker comprising:

a frame;

three or more rows of magnets mounted to the frame;

a diaphragm secured to the frame with an acoustic damper mounted opposite the diaphragm; and a thermoplastic acoustic lens spaced apart from the diaphragm for affecting the directivity of the loudspeaker by modification of an effective radiating area of the diaphragm, wherein a thickness of the acoustic lens is less than a distance between the acoustic lens and the diaphragm.

13. The electro-dynamic planar loudspeaker of claim 12 where the acoustic lens includes an acoustically opaque body and an aperture extending through the body.

14. The electro-dynamic planar loudspeaker of claim 13 where the body is substantially planar.

15. The electro-dynamic planar loudspeaker of claim 14 where the body extends across the surface area of the diaphragm.

16. The electro-dynamic planar loudspeaker of claim 14 where the substantially planar body extends substantially parallel to the diaphragm.

17. The electro-dynamic planar loudspeaker of claim 12 where the means for affecting the directivity of the loudspeaker is configured to reduce the effective radiating area of the diaphragm.

18. The electro-dynamic planar loudspeaker of claim 17 where the means for affecting the directivity of the loudspeaker is also configured to increase a beam width angle of the loudspeaker.

19. The electro-dynamic planar loudspeaker of claim 17 where the beam width angle is increased at frequencies between about 5 kHz and about 16 kHz.

20. The electro-dynamic planar loudspeaker of claim 17 where the means for affecting the directivity of the loudspeaker is also configured to increase an angular range at which a minimum sound pressure level is maintained relative to the on axis level.

21. The electro-dynamic planar loudspeaker of claim 20 where the angular range of minimum sound pressure level occurs on a plane normal to the diaphragm.

22. The electro-dynamic planar loudspeaker of claim 21 where the plane intersects a mid-point of the diaphragm.

23. The electro-dynamic planar loudspeaker of claim 17 where the means for affecting the directivity of the loudspeaker comprises a panel positioned adjacent the diaphragm to reduce the effective radiating area, the panel including an aperture extending through the panel.

24. An electro-dynamic planar loudspeaker, comprising:

a frame;

five rows of magnets coupled to the frame;

a diaphragm secured to the frame with an acoustic dampener mounted opposite the diaphragm;

an electrical circuit disposed on a surface of the diaphragm; and a thermoplastic panel coupled to the frame, the panel having a first portion and a second portion, the first portion being substantially acoustically opaque and the second portion being substantially acoustically transparent in a substantially linear direction, wherein the panel modifies the directivity pattern of the loudspeaker, wherein a thickness of the panel is less than a distance between the panel and the diaphragm.

25. The electro-dynamic planar loudspeaker of claim 24 where the panel is positioned substantially parallel to and offset from the diaphragm.

26. The electro-dynamic planar loudspeaker of claim 25 where the second portion of the panel comprises an aperture extending through the panel.

27. The electro-dynamic planar loudspeaker of claim 24 where the directivity pattern is modified to include an increased beam width.

28. The electro-dynamic planar loudspeaker of claim 27 where the beam width is increased at frequencies between about 5 kHz and about 10 kHz.

* * * * *